US006000336A

United States Patent [19]

Leib

[11] Patent Number: 6,000,336

[45] Date of Patent: Dec. 14, 1999

[54] APPLICATOR CYLINDER WITH SLEEVE HAVING RECESSES THEREIN TO RECEIVE GRIPPERS IN A SHEET-FED PRESS

[75] Inventor: Rudolf Leib, Wiesloch, Germany

[73] Assignee: Heidelberger Druckmaschinen Aktiengesellschaft, Heidelberg, Germany

[21] Appl. No.: 09/244,832

[22] Filed: Feb. 4, 1999

[30] Foreign Application Priority Data

Feb. 4, 1998 [DE] Germany ..... 198 04 269

[51] Int. Cl.[6] ..... B41F 1/30; B41F 5/02; B65H 29/06; B65H 5/12

[52] U.S. Cl. ..... 101/409; 101/408; 101/376; 101/216; 271/268; 271/82

[58] Field of Search ..... 101/216, 217, 101/368, 367, 401.1, 408–410; 271/82, 315, 314, 204, 268, 272, 277

[56] References Cited

U.S. PATENT DOCUMENTS

| | | | |
|---|---|---|---|
| 267,171 | 11/1882 | Feister . | |
| 1,027,516 | 5/1912 | Barber . | |
| 1,348,253 | 8/1920 | Upham . | |
| 1,701,055 | 2/1929 | Sheldon . | |
| 1,870,543 | 8/1932 | Wood . | |
| 5,797,322 | 8/1998 | Lorig et al. | 101/375 |
| 5,819,657 | 10/1998 | Rossini | 101/376 |
| 5,860,360 | 1/1999 | Lane, III et al. | 101/376 |

*Primary Examiner*—Kimberly L. Asher

*Attorney, Agent, or Firm*—Herbert L. Lerner; Laurence A. Greenberg

[57] ABSTRACT

A device for applying a liquid to a print carrier sheet in a sheet-fed rotary printing machine. The device has an applicator cylinder, an impression cylinder assigned to the latter and at least one gripper. The applicator cylinder carries a cylinder sleeve which applies the liquid to the print carrier and which has at least one recess, into which the gripper penetrates when the applicator cylinder and the impression cylinder roll one on the other.

25 Claims, 4 Drawing Sheets

APPLICATOR CYLINDER WITH SLEEVE HAVING RECESSES THEREIN TO RECEIVE GRIPPERS IN A SHEET-FED PRESS

BACKGROUND OF THE INVENTION

Field of the Invention

The invention relates to a device for applying a liquid to a print carrier sheet, in particular a printing or varnishing unit in a sheet-fed rotary printing machine. The printing or varnishing unit includes an applicator cylinder and an impression cylinder assigned to the applicator cylinder.

In the field of web-fed rotary printing, in particular in the flexographic and offset printing, printing form and rubber blanket sleeves are used in order to avoid vibrations and the spoilage which is caused by a clamping channel in the case of conventionally clamped printing plates and rubber blankets and occurring as a result of wide regions free of any printing image on the print carrier web.

Published, Non-Prosecuted German Patent Application DE 36 33 155 A1 describes a flexographic printing form cylinder having a sleeve which carries a printing block. Although the sleeve is simple to produce, the printing form cylinder can be used only in web-fed rotary printing, since the grippers, necessary in sheet-fed rotary printing for conveying the print carrier sheets on the impression cylinder, would collide with the printing block and destroy it.

Published, Non-Prosecuted German Patent Application DE 31 17 855 A1, corresponding to U.S. Pat. No. 4,399,767, describes a varnishing unit in a sheet-fed rotary printing machine, the applicator roller of which has a recess on the circumference in the axial direction. The recess allows the passage of the gripper units of the chain conveyor. The applicator roller is equipped with a plate clamping device, by which plates having either a smooth or an engraved surface can optionally be clamped. Furthermore, the block roller and the impression roller are disposed in such a way that their gaps coincide with the recess in the applicator roller during rotation. Although this varnishing unit can be used in sheet-fed rotary machines, clamping of the plates is complicated.

Furthermore, German Patent DE 43 07 320 C1 describes a printing machine for indirect printing methods, in which the rubber blanket sleeve can be pushed through an orifice in the machine side wall. Although it is possible to exchange the sleeve in a simple way in the printing machine, it is not possible for the rubber blanket sleeve, which has a closed circumferential surface without any gap(s), to be used in sheet-fed rotary printing machines.

Moreover, varnishing units configured for flexographic printing units are known in sheet-fed offset machines. In contrast to web-fed rotary printing, instead of sleeve systems, varnishing plates and varnishing blankets are clamped onto a cylinder in a similar way to sheet-fed printing units. These plates are difficult to produce and present handling problems. In order to clamp the plates and blankets so as to have an accurate fit, complicated plate supply devices and clamping devices are required. On account of the warping of conventional flexographic plates, varnishing plates with an aluminum carrier are employed. For drawing them onto the cylinder, a pressure roller is used, which may damage the relief of the polymer plate if an excessive pressing force is exerted. In the case of a relatively large sheet format, it is necessary to have two operators. Therefore, in-register fitting of the plates requires a high outlay.

SUMMARY OF THE INVENTION

It is accordingly an object of the invention to provide a device for applying a liquid to a print carrier sheet, in particular a printing or varnishing unit, in a sheet-fed rotary printing machine, that overcomes the above-mentioned disadvantages of the prior art devices of this general type, which makes it possible for the printing or varnishing form or the rubber or varnishing blanket to be exchanged simply and carefully.

With the foregoing and other objects in view there is provided, in accordance with the invention, a device for applying a liquid to a print carrier sheet in a sheet-fed rotary printing machine, the device includes: an applicator cylinder; an impression cylinder having at least one gripper and associated with the applicator cylinder; and a cylinder sleeve having at least one recess formed therein and disposed on the applicator cylinder, the cylinder sleeve receiving a liquid and applying the liquid to a print carrier sheet disposed on the impression cylinder, the at least one gripper penetrating into the at least one recess when the applicator cylinder and the impression cylinder roll one on another.

The device according to the invention for applying the liquid to the print carrier sheet in the sheet-fed rotary printing machine, has the applicator cylinder, the impression cylinder assigned to the latter, and the at least one gripper. The invention is distinguished in that the applicator cylinder carries a cylinder sleeve which applies the liquid to the print carrier and which has at least one recess, into which the gripper penetrates when the applicator cylinder and the impression cylinder roll one on the other.

It was recognized that the use of sleeve technology in sheet-fed rotary printing is advantageous and that it is necessary to adapt a printing form or rubber blanket sleeve applying the varnish or the printing ink to the print carrier. The cylinder sleeve must be provided with one or more recesses, where each recess matches the gripper or grippers of the impression cylinder assigned to the applicator cylinder. The recess is shaped geometrically in such a way that each gripper passes the recess contactlessly during the rotation of the cylinders.

The applicator cylinder may be configured as a transfer cylinder with a rubber blanket sleeve in offset printing units, as a printing form cylinder with a direct lithography sleeve in direct lithography printing units operating by direct planographic printing, as a printing form cylinder with a flexographic sleeve in flexographic printing units, as a printing form cylinder with a letterpress printing sleeve in letterpress printing units, and as a varnishing cylinder with a block or varnishing blanket sleeve in varnishing units. A particularly favorable configuration is obtained in the case of a device operating by the direct printing method. In this case, the printing ink or the varnish is transferred directly from the inked printing form onto the print carrier.

According to a preferred development, the exchange of the cylinder sleeve can be made easier by an air cushion, on which the cylinder sleeve in this case slides. In order to achieve a firm fit of the cylinder sleeve on the applicator cylinder, retention methods are preferably provided, which block any rotation of the cylinder sleeve in the circumferential direction of the cylinder during the printing operation. A rotationally firm fit of the cylinder sleeve may also be achieved solely by virtue of its frictional connection to the applicator cylinder. In which case the cylinder sleeve, in particular an inner carrier layer of the cylinder sleeve, which is located on the applicator cylinder and is capable of being expanded in the radial direction by the compressed air, shrinks again, and fits sufficiently firmly, after the compressed air cushion has been cancelled.

According to a further embodiment, the cylinder sleeve may be of multi-layer construction. The layers may be connected firmly to one another, for example adhesively bonded or foamed one onto the other. As a result of this sandwich construction, layers of different kinds having different properties are combined and optimum overall functioning of the cylinder sleeve is achieved. A four-layer configuration is preferred.

An inner carrier layer can give the cylinder sleeve a hold and may be constructed to be stretchable, so that radial expansion and contraction for changing the cylinder sleeve are afforded, in addition to rigidity.

An applicator layer transferred in the liquid, that is to say the printing ink or the varnish, may form a relief-like surface (block) corresponding to a letterpress or flexographic printing form or a smooth surface corresponding to a varnishing blanket applying varnish over the entire surface.

An intermediate layer may be disposed between the inner carrier layer and the applicator layer. The intermediate layer influences the compressive stress necessary for applying ink or varnish to the print carrier. The possible adaptation of the intermediate layer hardness is particularly advantageous in the case of an applicator layer configured as a letterpress printing form. Complete printout of such a printing or varnishing form, without the raised surface portions of the printing form being squeezed, is ensured in that the intermediate layer is correspondingly elastic or compressible. The intermediate layer is preferably constructed to be softer than the applicator layer, the latter layer being constructed to be particularly wear-resistant.

An outer carrier layer, for example a block carrier layer, which carries the applicator layer, may be disposed between the intermediate layer and the applicator layer. The outer carrier layer allows a defined transmission of the compressive stress from the applicator layer to the intermediate layer. For this purpose, the outer carrier layer may be configured to be film-thin, while the thickness of the applicator layer may be, for example, 0.2 to 0.5 mm. Configuring the intermediate layer so as to be even thicker than the applicator layer makes it possible to achieve a highly variable compressive stress setting in the case of a greater or lesser deformation of intermediate layer.

Each recess may extend in the radial direction through the entire cylinder sleeve, for example as a bottomless bore passing through all four layers described above. In this case, if appropriate, no outlet orifices for the compressed air are provided on the applicator cylinder in the region of the recess, so that pressure losses due to absent air are avoided. Preferably, however, the inner carrier layer may be left unrecessed, the cylinder sleeve being narrowed in the region of the recess. If the cylinder sleeve is configured in this way, a compressed air cushion which is particularly uniform over the entire circumference of the applicator cylinder can be generated, even though a compressed air source may have lower power.

If the applicator layer or the applicator layer and outer carrier layer together have a thickness which is sufficient in terms of the amount by which the grippers penetrate into the region of the applicator cylinder, it is possible for this layer or these layers only to have the recess. The grippers often project to a greater extent beyond the periphery of the cylinder guiding the print carrier sheet. In order to ensure that the grippers are, on all sides, at a distance from the inner faces of the recess, in particular in the radial direction of the applicator cylinder, the intermediate layer may be recessed in this case. The intermediate layer may be recessed continuously or be partially narrowed. An intermediate layer region completely recessed or radially narrowed in the region of the penetrating grippers may be covered by one or more layers lying above it. For example, during the production of the printing form, the applicator layer may be removed, with the exception of the outer carrier layer, so that only the latter layer completely covers the intermediate layer. Also, as a consequence of production, the applicator layer, together with the outer carrier layer, may cover the recess. It is essential, in all cases, that a depression, for example a bore, pit or dip, be provided for the grippers on the outer circumference of the sleeve. Preferably, the thickness of the cylinder sleeve wall, consequently the thickness of all the layers together in the case of a multi-layer cylinder sleeve, is somewhat greater than the amount by which the grippers project beyond the circumferential surface of the impression cylinder or of a print carrier sheet resting on the latter. In this case, the grippers penetrate solely into the cylinder sleeve. Furthermore, it is also possible to introduce into the impression cylinder, below the cylinder sleeve recess, a further recess that is disposed congruently with the latter. In this case, the grippers also penetrate through the recess in the cylinder sleeve into the recess of the impression cylinder.

A constructively uncomplicated configuration of the applicator unit can be achieved if the method, for example an inking unit, transferring the liquid onto the applicator cylinder includes an engraved roller with wells receiving the liquid and webs, left between these, on the circumferential surface. The engraved roller may be coated ceramically, so that it is possible, without any appreciable wear of the engraved roller, to use an inking rail that bears against the latter. With a varnishing or printing unit configured in this way, a wide variety of types of varnish and printing inks, for example special inks, can be applied. It is advantageous if a feeder feeding the varnish or printing inks directly to the engraved roller is configured as an inking rail device. This ensures particularly accurate metering of the liquid, in particular a liquid of higher viscosity, for example bronze printing ink or gold varnish.

A preferred embodiment of the invention involves configuring the engraved roller in the form of a roller core, onto which an engraved roller sleeve is pushed. The roller sleeve may have an outer cylindrical surface configured to be particularly wear-resistant for the use of the inking rail. The roller sleeve may be pushed on and drawn off in the same way as the cylinder sleeve, the roller core corresponding, in this respect, to the applicator cylinder and be capable of being constructed accordingly. An engraved roller carrying the roller sleeve allows a particularly quick and simple changeover of the device in the case of frequently changing print orders that necessitate this. Such a configuration of the device is described and shown in the following exemplary embodiment.

The impression cylinder may carry a single sheet holding element raised relative to the circumferential surface or a plurality of sheet holding elements. As a rule, the print carrier sheet is clamped and held at its leading edge by a plurality of grippers, the grippers being disposed at a distance from another in a row axially parallel to the axis of rotation of the impression cylinder. In this case, the recess may be configured preferably as a groove-shaped channel that extends parallel to the axis of rotation and also to that of the applicator cylinder and which extends in the axial direction over all the grippers. Alternatively, a plurality of recesses may be provided, which form a row matching the gripper row.

The device according to the invention makes it possible to employ sleeve technology in all printing or varnishing units.

In which the applicator cylinder is assigned to an impression cylinder guiding the print carrier sheet and having a sheet holding element projecting beyond the impression cylinder periphery, and, in particular, in all sheet-fed rotary printing machines.

Other features which are considered as characteristic for the invention are set forth in the appended claims.

Although the invention is illustrated and described herein as embodied in a device for applying a liquid to a print carrier sheet, in particular a printing or varnishing unit, in a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
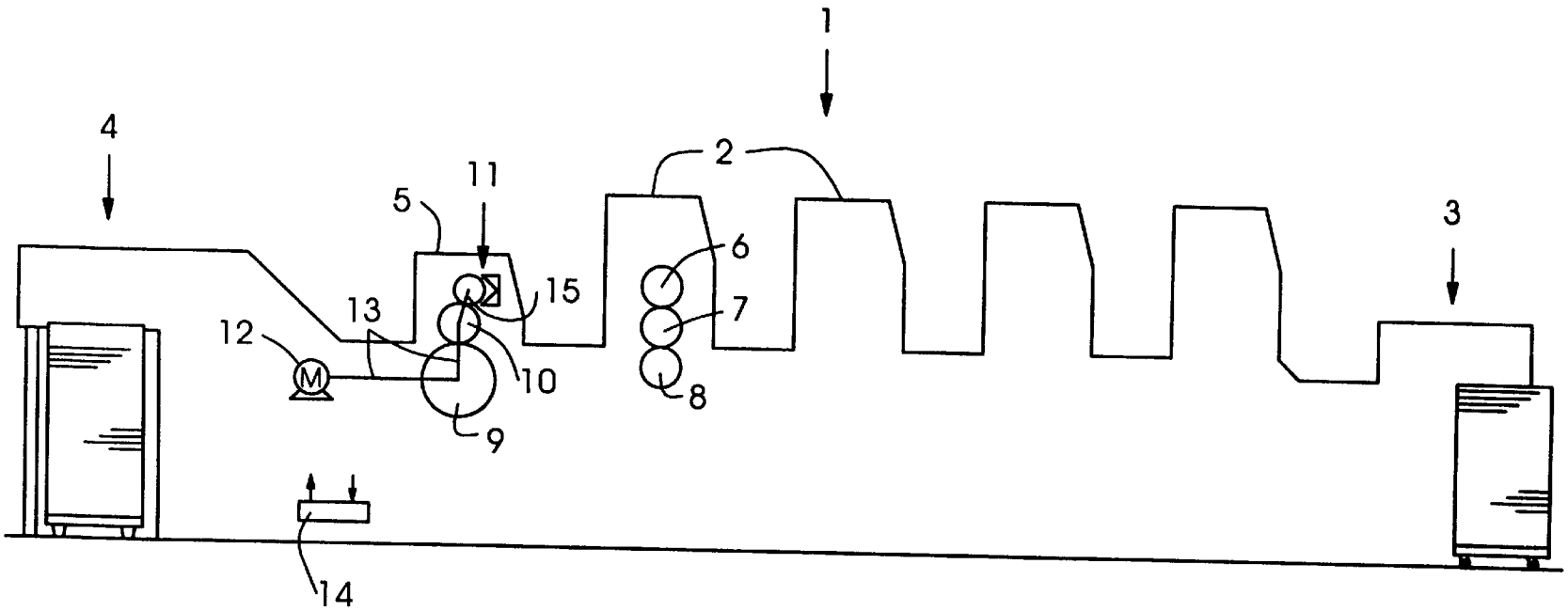
FIG. 1 is a diagrammatic, side-elevation view of a sheet-fed offset rotary printing machine with a varnishing unit which includes a device according to the invention.

In all the figures of the drawing, sub-features and integral parts that correspond to one another bear the same reference symbol in each case. Referring now to the figures of the drawing in detail and first, particularly, to FIG. 1 thereof, there is shown a sheet-fed rotary printing machine 1 with printing units 2, a sheet feeder 3, a sheet delivery 4 and a coating unit 5 configured as a varnishing unit. Each printing unit 2 includes a printing form cylinder 6, a rubber blanket cylinder 7 and an impression cylinder 8. The coating unit 5 includes an impression cylinder 9 and an applicator cylinder 10 assigned to the latter. The applicator cylinder 10 is assigned a supply device 11 for supplying the applicator cylinder 10 with a liquid 20 (FIG. 2). The supply device 11 includes a transfer roller 15 for transferring the liquid 20 onto the applicator cylinder 10. The cylinders 9, 10 and the roller 15 are driven in rotation, via a gear 13 configured, for example, as a toothed gear, from a drive 12 which functions, for example, as an electronic main drive of the printing machine 1. The printing machine 1, its coating unit 5 and the drive 12 are controlled by an electronic controller 14 with the aid of a microprocessor.

Figure 2:
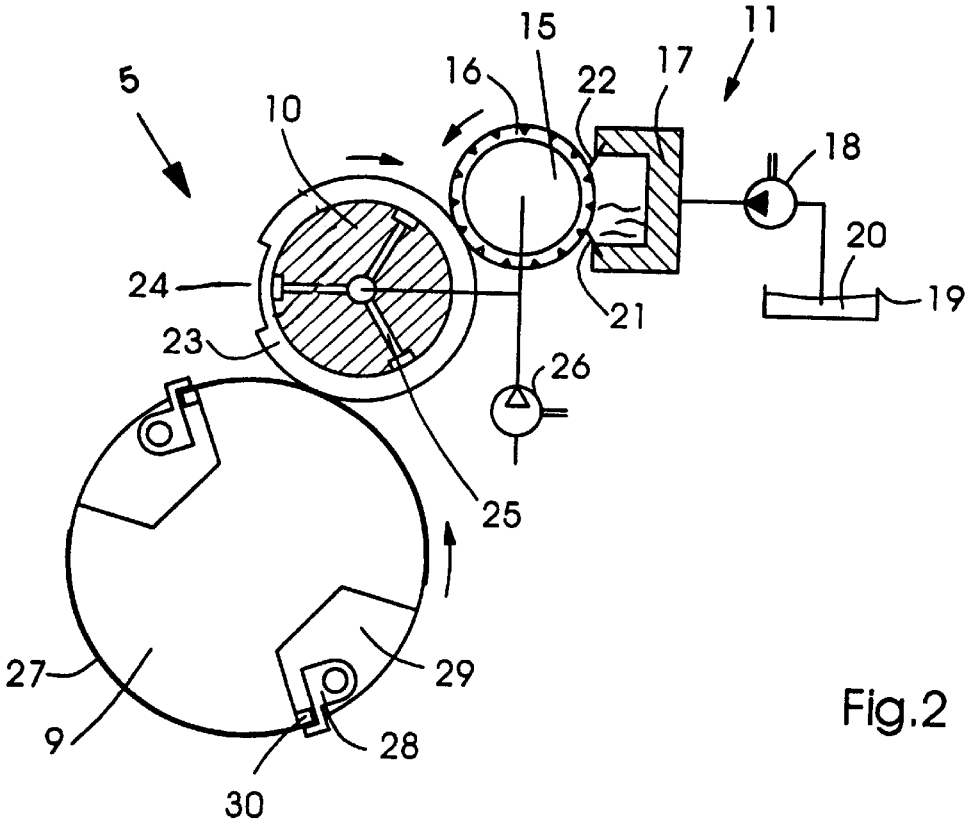
FIG. 2 is a side-elevational view of the varnishing unit from FIG. 1 that includes an applicator cylinder with a cylinder sleeve.

FIG. 2 further illustrates in more detail the coating unit 5 shown in FIG. 1. The impression cylinder 9 and the applicator cylinder 10, oriented axially parallel to the latter, are thrown one onto the other and roll one on the other. A printer carrier sheet 27 rests on a circumferential surface of the impression cylinder 9 and is clamped at the leading edge between gripper supports 30 and grippers 28. Each gripper 28 is disposed in a cylinder gap 29. The applicator cylinder 10 carries a cylinder sleeve 23, drawn onto the latter, and has a system of compressed air ducts 25 with the compressed air ducts 25 opening into outlet orifices on the outer surface of the applicator cylinder 10. The system of compressed air ducts 25 is fed with compressed air by a compressed air source 26. The compressed air source 26, is configured, for example, as a compressor, generates the compressed air cushion necessary for fastening the cylinder sleeve 23 and a roller sleeve 16. The system of compressed air ducts 25 has a middle central duct and radial ducts branching off from the latter. The radial ducts open into further ducts which are of groove-shaped construction and which extend parallel to the axis of rotation of the applicator cylinder 10 in the region of the fit of the cylinder sleeve 23. The transfer roller 15, onto which the roller sleeve 16 is drawn, is thrown, with contact, onto the applicator cylinder 10. A feeder 17 for feeding the liquid 20 stored in a reservoir 19 to the transfer roller 15 is constructed as an inking rail device which has a positive inking rail 21 and a negative inking rail 22. A pump 18 conveys the liquid 20 from the reservoir 19 to the feeder 17 and, for example, fills the inking rail device. The cylinder sleeve 23 surrounds the applicator cylinder 10 in the circumferential direction without any gaps. The inside diameter of the cylinder sleeve 23 not yet pushed onto the applicator cylinder 10 is slightly smaller (press fit) than the outside diameter of the applicator cylinder 10, in which case, after the compressed air cushion between the outer surface of the applicator cylinder 10 and the inner surface of the cylinder sleeve 23 has been cancelled, the cylinder sleeve 23 fitted onto the applicator cylinder 10 fits virtually without any play as a result of the surface pressure prevailing between the surfaces. The impression cylinder 9 and the applicator cylinder 10 have outer circumferences adapted to one another, so that, during each revolution of the impression cylinder 9, the grippers 28 once again come exactly into coincidence with a recess 24. The cylinders 9, 10 may be the same size. However, as shown, the circumference of the impression cylinder 9 may also be a multiple of the circumference of the applicator cylinder 10, in which case, for example, the applicator cylinder 10 may be configured to be single-size and the impression cylinder 9 to be double-size, that is to say guiding two print carrier sheets 27 simultaneously.

Figure 3:
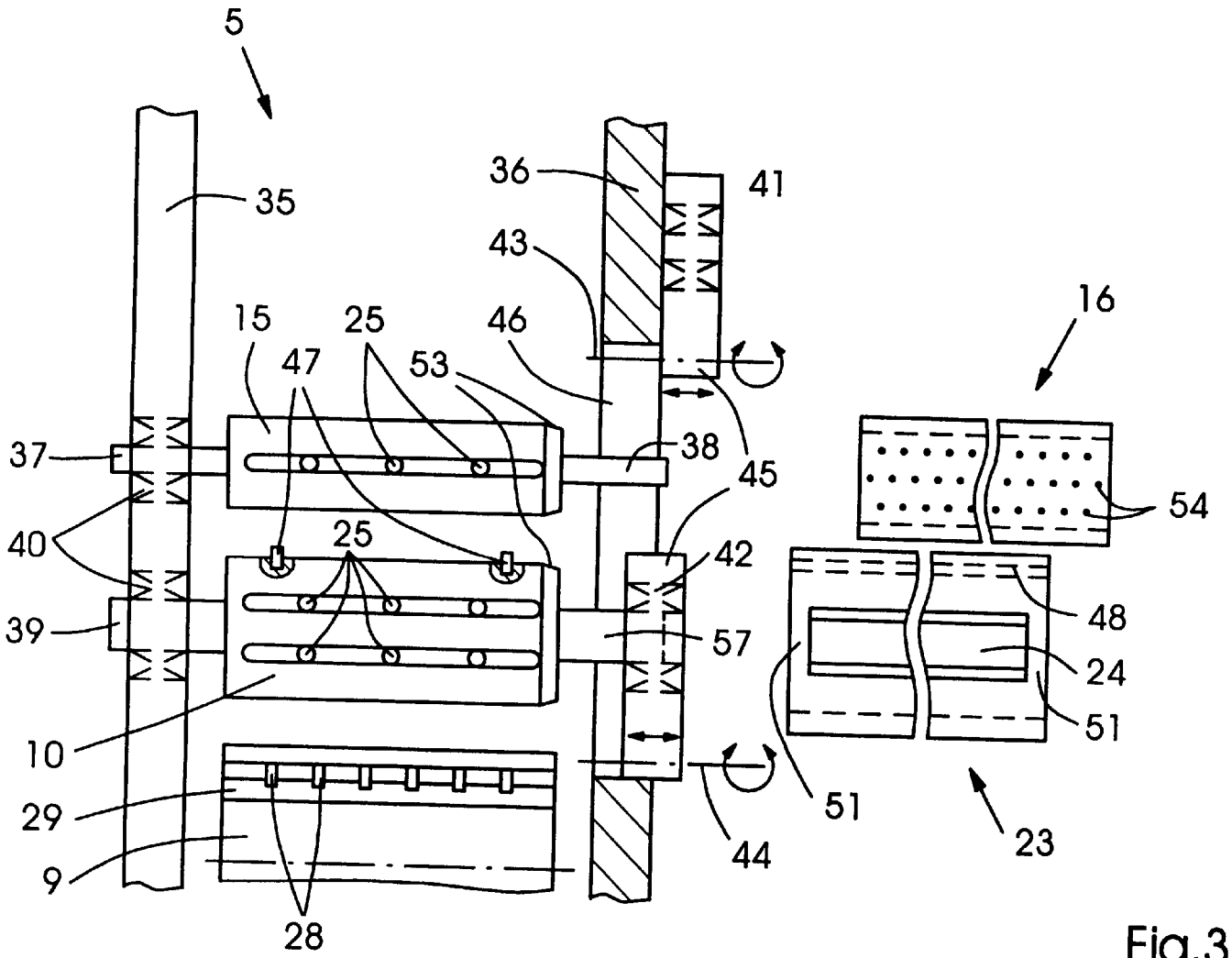
FIG. 3 is a front, sectional view of the varnishing unit shown in FIG. 2.

FIG. 3 illustrates a front view of the coating unit 5 from FIG. 2. The impression cylinder 9, the applicator cylinder 10 and the transfer roller 15 are mounted in a stand, which is formed by side walls 35 and 36, in that journals 37 to 39, 57 are received in rotary bearings 40 to 42. The side wall 36 can be opened, in order to exchange the sleeves 16, 23, by the removal of a wall piece 45 or a plurality of wall pieces 45. The bearings 41, 42 disposed on the same side as the orifice 46 are configured to be releasable and the opposite bearings 40 to be particularly stable or fixed. The bearing 41 can be drawn off from the transfer roller 15 and pivoted away as shown in FIG. 3. The bearing 42 can be drawn off from the applicator cylinder 10 and likewise pivoted away. The bearings 41, 42 are drawn off from the journals 38, 57 in the axial direction and pivoted, together with the wall pieces 45, about the axes 43, 44. FIG. 3 illustrates the bearing 41 as being drawn off and subsequently pivoted away. The bearing 41 can be retained in this position. The bearing 42 is illustrated as not yet being drawn off completely. After the bearings 41, 42 have been released, the applicator cylinder 10 and the transfer roller 15 are held on one side by the bearings 40. The sleeves 16, 23 can be changed through the orifice 46. In order to attach the sleeves 16, 23, end-face cones 53 are provided on the transfer roller 15 and on the applicator cylinder 10. The cones 53 fixing and centering the sleeves 16, 23 slipped onto the cones 53, before the sleeves 16, 23 are pushed in the axial direction respectively onto the transfer roller 15 and the applicator cylinder 10 under the effective action of compressed air. The roller sleeve 16 is constructed as a hollow cylinder with wells 54 introduced into the outer circumferential surface and disposed in a screen-like manner. The wells 54 are filled with the liquid 20 by the feeder 17 (FIG. 2) and dispense the liquid 20 onto an applicator layer 31 (FIG. 4) of the cylinder sleeve 23. Positive sleeve fixing components 47, 48 are provided for fixing the cylinder sleeve 23 on the applicator roller 10. The sleeve fixing components 47, 48 are formed of two parts, for example pins 47, which engage one into the other and which slide in a groove 48 in the axial direction, when the cylinder sleeve 23 is pushed onto the applicator cylinder 10, and which are surrounded by the groove 48. Therefore, the cylinder sleeve 23 is blocked against displacement in the circumferential direction relative to the applicator cylinder 10. Register accuracy between the applicator cylinder 10 and the impression cylinder 9 is thereby ensured, even under maximum load in the applicator nip. Positive sleeve fixing of this kind may also be assigned to the transfer roller 15 and the roller sleeve 16. The cylinder sleeve 23 is provided with a recess 24 that extends in the direction of the axis of rotation over all the grippers 28 of the gripper row. The recess 24 is configured in the form of a large groove, into which the grippers 28 penetrate at the contact point between the applicator cylinder 10 and the impression cylinder 9. The width of the recess 24 is dimensioned in such a way that in no phase of movement do the penetrating grippers 28 touch a leading inner flank or a trailing inner flank of the recess 24. The recess 24 is constructed to be so deep that the backs of the grippers 28 do not butt on the bottom of the recess 24. During the rotation of the cylinders 9, 10, therefore, all the grippers 28 pass the recess 24, without touching the cylinder sleeve 23. Simplified maintenance of the device is achieved if the applicator cylinder 10 is assigned the cylinder sleeve 23. Since the transfer roller 15 is also additionally assigned the roller sleeve 16, a further reduction in the setup times is achieved.

It is particularly advantageous if the applicator cylinder 10 is mounted on both sides in the mountings 40, 42 and the mounting 42 assigned to the openable side wall 36 is releasable, so that the cylinder sleeve 23 can be pushed onto the applicator cylinder 10 and drawn off from the latter through the opened side wall 36. It is advantageous, furthermore, if the transfer roller 15, configured as an engraved roller, is mounted on both sides in the mountings 40, 41 and the mounting 42 assigned to the openable side wall 36 is releasable, so that the roller sleeve 16 can be pushed onto the transfer roller 15 and drawn off from the latter through the opened side wall 36. The bearings 40, 41, 42, constructed as rotary mountings, may, for example, be rolling or sliding bearings. With regard to the lightweight roller sleeve 16, there is, in particular, the advantage that it is possible for it to be changed manually, without assistance by a crane. As a rule, in the devices belonging to the prior art, cranelike handling devices are necessary for changing heavy engraved rollers. Register corrections that may possibly be necessary can be carried out on the complete applicator cylinder 10 by remote control, for example by the electronic controller 14 (FIG. 1), in that the phase relationship between the applicator cylinder 10 and the impression cylinder 9 can be adjusted. For this purpose, an adjustment of the gear 13 (FIG. 1) may be carried out.

Figure 4:
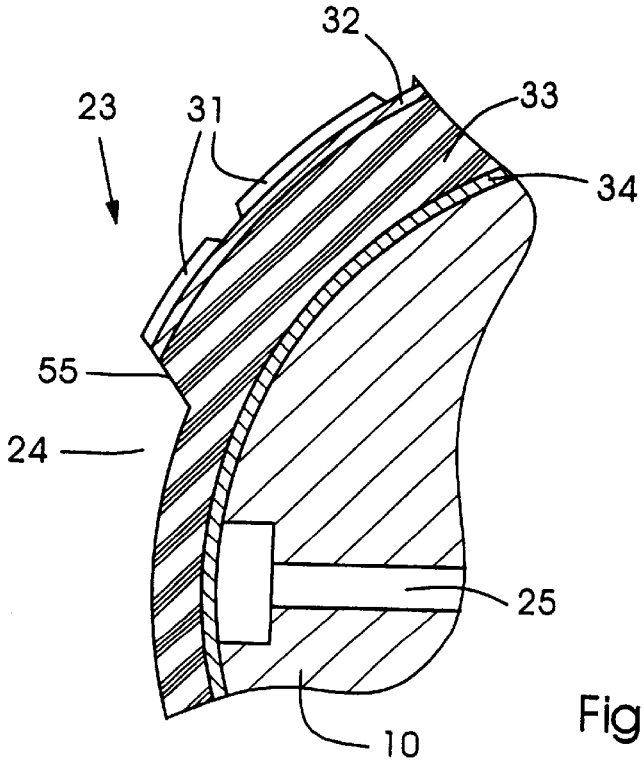
FIG. 4 is a fragmentary, side-elevational view of a first embodiment of the cylinder sleeve shown in FIG. 2.

FIG. 4 shows, on an enlarged scale, a detail of the cylinder sleeve 23 illustrated in FIG. 2. The cylinder sleeve 23 may be formed of a single material, for example a metal or a plastic. The preferred embodiment illustrated in FIG. 4 includes an inner carrier layer 34 which forms an inner sleeve and which may be formed of a metal, for example nickel, or a plastic, for example glass fiber reinforced plastic. The inner carrier layer 34 may be configured as an inner sleeve with a gap running in the axial direction or preferably as a gapless inner sleeve. If the inner carrier layer 34 has a gap, a further layer, for example the intermediate layer 33, covering the gap and disposed above the inner carrier layer 34 is provided. The intermediate layer 33 is compressible and may consist, for example, of foamed polyurethane. Bubble-shaped voids and air inclusions in the intermediate layer 33 may be provided to a greater or lesser extent, so that the hardness of the intermediate layer 33 can thereby be adapted to the respective conditions of use. An outer carrier layer 32 is disposed above the intermediate layer 33 and may be formed, for example, of polyester. An applicator layer 31 is disposed on the outer carrier layer 32 and corresponds to a printing layer of a letterpress printing form and consists of a flexible material, for example a photopolymer or a rubber-based material. The layers 31 to 34 are firmly connected to one another. The intermediate layer 33 is thicker than the other layers 31, 32, 34 and thicker by a multiple than the applicator layer 31, the latter being thicker by a multiple than the outer carrier layer 32. The recess 24 is constructed as a groove-shaped channel which extends in the axial direction and the leading and trailing flanks 55 of which are beveled, the flanks 55 forming an obtuse angle with the tangential plane in the region of the bottom of the recess 24. The recess 24 is formed by full recessing of the applicator layer 31 and of the outer carrier layer 32 and partial recessing of the intermediate layer 33 in the radial direction.

Figure 5:
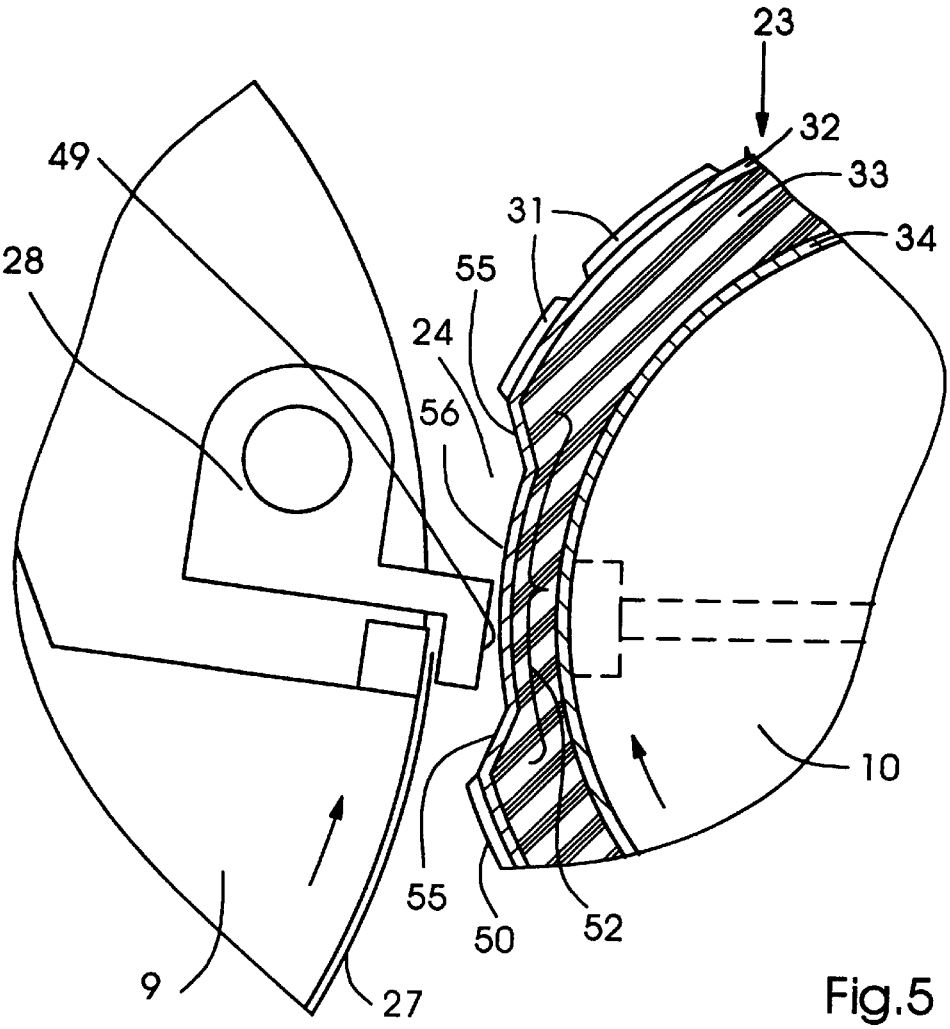
FIG. 5 is a fragmentary, side-elevational view of a second embodiment of the cylinder sleeve shown in FIG. 2.

FIG. 5 illustrates an embodiment of the cylinder sleeve 23 which is an alternative to the embodiment illustrated in FIG. 4 and in which the intermediate layer 33, recessed in the region 52, is covered completely by the outer carrier layer 32. Another difference between the embodiment shown in FIG. 5 and the embodiment shown in FIG. 4 is that the channel-shaped recess 24 of the cylinder sleeve 23 shown in FIG. 5 extends over the entire width of the cylinder sleeve in the axial direction. While, in contrast to this, the embodiment of the cylinder sleeve 23, as shown in FIG. 4, has a recess 24 delimited by lateral supporting regions 51 (FIG. 3). The cylinder sleeve 23 shown in FIG. 5 otherwise corresponds, in its configuration, to the cylinder sleeve 23 shown in FIG. 4. FIG. 5 shows, furthermore, how the pivotable gripper 28 penetrates into the recess 24. Here, the point of the gripper 28 which is outermost in the radial direction with respect to the impression cylinder 9, is a so-called gripper back 49, moves within the recess 24. As seen in the radial direction of the applicator cylinder 10 with respect to a periphery 50 of the latter, the gripper 28 moves below the peripheral line. The periphery 50 is determined by the outer circumferential surface of the applicator layer 31. A region 52 of the recess 24 is dimensioned in such a way that, while the cylinders 9, 10 are rolling one on the other, the gripper 28 under no circumstances collides with the applicator cylinder 10 and, in particular, with the flanks 55 and a bottom 56 of the recess 24.

Figure 6:
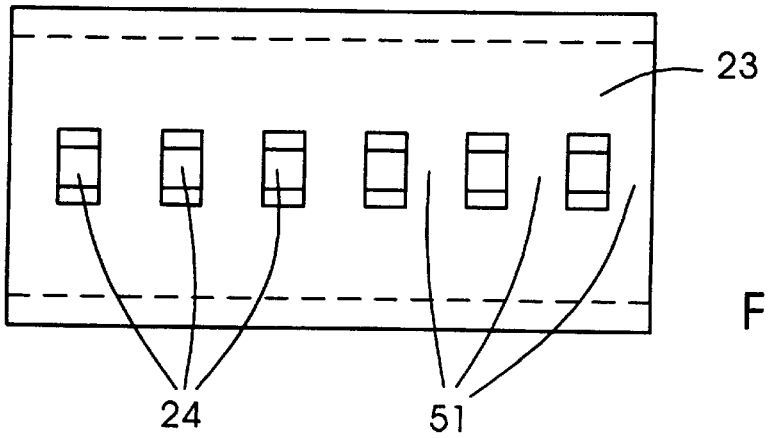
FIG. 6 is a top plan view of a third embodiment of the cylinder sleeve with a plurality of recesses.

FIG. 6 illustrates a further embodiment which is an alternative to the above-described embodiments of the cylinder sleeve 23, a plurality of recesses 24 assigned to the grippers 28 (FIG. 3) being provided here. Each gripper 28 may be assigned a single recess 24. The supporting regions 51 located between the recesses 24 bring about additional stability of the cylinder sleeve 23 and particularly quiet running of the device. The recesses 24 are configured, here, as pits that form a row corresponding to the gripper row and extending in the axial direction. The supporting regions 51 are configured as webs between the recesses 24.

I claim:

1. A device for applying a liquid to a print carrier sheet in a sheet-fed rotary printing machine, the device comprising:

an applicator cylinder;

an impression cylinder having at least one gripper associated with said applicator cylinder; and a cylinder sleeve having at least one recess formed therein and disposed on said applicator cylinder, said cylinder sleeve receiving a liquid and applying the liquid to a print carrier sheet disposed on said impression cylinder, said at least one gripper penetrating into said at least one recess when said applicator cylinder and said impression cylinder roll one on another.

2. The device according to claim 1, wherein said applicator cylinder has a circumferential surface and compressed air ducts with outlet orifices formed therein and extending from said circumferential surface, and including a compressed air source supplying compressed air to said compressed air ducts for forming a compressed air cushion for assisting in pushing said cylinder sleeve onto said applicator cylinder and for assisting in drawing said cylinder sleeve off of said applicator cylinder.

3. The device according to claim 1, including a sleeve fixing component for securing a proper positioning of and form lockingly connecting said cylinder sleeve on said application cylinder.

4. The device according to claim 1, wherein said cylinder sleeve is a multi-layered cylinder sleeve.

5. The device according to claim 4, wherein said multi-layered cylinder sleeve has at least four different layers.

6. The device according to claim 4, wherein said multi-layered cylinder sleeve has a rigid inner carrier layer.

7. The device according to claim 6, wherein said rigid inner carrier layer is formed of a material selected from the group consisting of a metal and glass fiber reinforced plastic.

8. The device according to claim 6, wherein said multi-layered cylinder sleeve has a compressible intermediate layer.

9. The device according to claim 8, wherein said compressible intermediate layer is formed of an elastomer.

10. The device according to claim 8, wherein said multi-layered cylinder sleeve has a flexible outer carrier layer.

11. The device according to claim 10, wherein said flexible outer carrier layer is formed of a material selected from the group consisting of plastics and film-thin plastics.

12. The device according to claim 10, wherein said multi-layered cylinder sleeve has a flexible applicator layer.

13. The device according to claim 12, wherein said flexible applicator layer is a letterpress printing form formed of a material selected from the group consisting of a photopolymer and rubber.

14. The device according to claim 12, wherein said compressible intermediate layer is substantially thicker than said flexible applicator layer, and said flexible applicator layer is substantially thicker than said flexible outer carrier layer.

15. The device according to claim 12, wherein said compressible intermediate layer is more compressible in a radial direction than said flexible applicator layer.

16. The device according to claim 8, wherein said at least one recess is formed in said compressible intermediate layer.

17. The device according to claim 16, wherein said compressible intermediate layer is partially narrowed.

18. The device according to claim 16, wherein said compressible intermediate layer is covered in a region of said at least one recess by at least one of said flexible outer carrier layer and said flexible applicator layer.

19. The device according to claim 16, wherein said compressible intermediate layer is covered in a region of said at least one recess by said flexible outer carrier layer.

20. The device according to claim 1, including a transfer roller being an engraved roller and associated with said applicator cylinder, said transfer roller transferring the liquid onto said cylinder sleeve.

21. The device according to claim 20, including a roller sleeve disposed on said transfer roller.

22. The device according to claim 21, wherein said roller sleeve is an engraved roller sleeve.

23. The device according to claim 1, wherein said at least one gripper is one of a plurality of grippers disposed in an axially parallel row, and said at least one recess is a channel extending in the axial direction and associated with said plurality of grippers.

24. The sheet-fed rotary printing machine according to claim 1, wherein the device is a printing unit operating by a direct printing method.

25. The sheet-fed rotary printing machine according to claim 1, wherein the device is a varnishing unit operating by a direct printing method.

* * * * *